US008443570B2

(12) United States Patent
Olariu

(10) Patent No.: US 8,443,570 B2
(45) Date of Patent: May 21, 2013

(54) WINDOW JAMB CHANNEL ATTACHMENT APPARATUS AND METHOD

(76) Inventor: Gabriel Lucian Olariu, Clarksburg, MD (US)

( * ) Notice: Subject to any disclaimer, the term of this patent is extended or adjusted under 35 U.S.C. 154(b) by 0 days.

(21) Appl. No.: 13/311,157

(22) Filed: Dec. 5, 2011

(65) Prior Publication Data

US 2013/0091781 A1 Apr. 18, 2013

Related U.S. Application Data

(60) Provisional application No. 61/547,697, filed on Oct. 15, 2011.

(51) Int. Cl.

| | |
|---|---|
| ***E04G 21/00*** | (2006.01) |
| ***E04G 23/00*** | (2006.01) |
| ***E04G 3/20*** | (2006.01) |
| ***E06B 3/964*** | (2006.01) |
| ***E06B 3/988*** | (2006.01) |
| ***A47L 3/00*** | (2006.01) |

(52) U.S. Cl.
USPC ..... 52/745.16; 52/204.69; 52/204.7; 52/37

(58) Field of Classification Search
USPC ..... 52/37, 204.7, 204.69, 204.62, 204.58, 52/745.15, 745.16, 718.03; 211/87.01
See application file for complete search history.

(56) References Cited

U.S. PATENT DOCUMENTS

| | | | | |
|---|---|---|---|---|
| 5,080,238 | A * | 1/1992 | Hochman | 211/59.1 |
| 5,538,144 | A * | 7/1996 | Reed | 211/32 |
| 6,675,980 | B2 * | 1/2004 | Ehrgott | 211/189 |
| 7,669,822 | B2 * | 3/2010 | Kluge et al. | 248/308 |
| 2005/0045573 | A1 * | 3/2005 | Winig et al. | 211/90.02 |
| 2007/0209300 | A1 * | 9/2007 | Rhode et al. | 52/204.1 |
| 2008/0047099 | A1 * | 2/2008 | Malek | 16/197 |

* cited by examiner

*Primary Examiner* — William Gilbert
*Assistant Examiner* — Kyle Walraed-Sullivan
(74) *Attorney, Agent, or Firm* — Maier & Maier PLLC

(57) ABSTRACT

A window jamb channel attachment apparatus. The apparatus can include a channel clip, the channel clip including a first foot, a second foot, a first leg, a second leg, and a joining portion, the first foot and the second foot adapted to couple to a window jamb channel, the first leg having a first end coupled to the first foot and a second end coupled to the joining portion, the second leg having a first end coupled to the second foot and a second end coupled to the joining portion, the joining portion including an aperture defined therein. The apparatus can further include an object holder removably coupled to the channel clip, the object holder including a body, a fastener portion sized and shaped to be received in the aperture of the channel clip, and an object support portion.

13 Claims, 19 Drawing Sheets

WINDOW JAMB CHANNEL ATTACHMENT APPARATUS AND METHOD

CROSS-REFERENCE TO RELATED APPLICATIONS

This application claims priority to U.S. Provisional Application 61/547,697, filed Oct. 15, 2011 and entitled CHANNEL CLIP WITH SUPPORT AND SEALING MEANS, the entire contents of which are hereby incorporated by reference.

BACKGROUND

Window decorations for holidays, window treatments and other devices that are displayed alongside windows (such as thermometers) are traditionally mounted using suction cups that attach to the window glazing or hardware that is permanently fastened to the wall sections around the window. Additionally, in some use scenarios such as in rented apartments, the tenants might not be allowed to make intrusive changes to the building walls and window frames. As such, a non-intrusive solution for attaching objects to windows is desired.

Solutions for non-intrusive attachment of objects and accessories to windows include, for example, suction cups and adhesives such as double sided tape. However, these tend to detach easily and become unusable over time. Furthermore, in some types of windows, the sealing between the window sash and the window frame is insufficient, resulting in poor insulation and increased utility bills. A solution for securely and non-intrusively mounting objects on windows is therefore desired. A solution for mounting objects on windows that allows for repetitive use is also desired. A solution for improving sealing and insulation of window frames is also desired.

SUMMARY

According to at least one exemplary embodiment, a window jamb channel attachment apparatus is disclosed. The apparatus can include a channel clip, the channel clip including a first foot, a second foot, a first leg, a second leg, and a joining portion, the first foot and the second foot adapted to couple to a window jamb channel, the first leg having a first end coupled to the first foot and a second end coupled to the joining portion, the second leg having a first end coupled to the second foot and a second end coupled to the joining portion, the joining portion including an aperture defined therein. The apparatus can further include an object holder removably coupled to the channel clip, the object holder including a body, a fastener portion sized and shaped to be received in the aperture of the channel clip, and an object support portion.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a window jamb channel attachment apparatus may be disclosed. The window jamb channel attachment apparatus may include a channel clip 50, an object holder 60, and an insulating portion 90.

Figure 1:
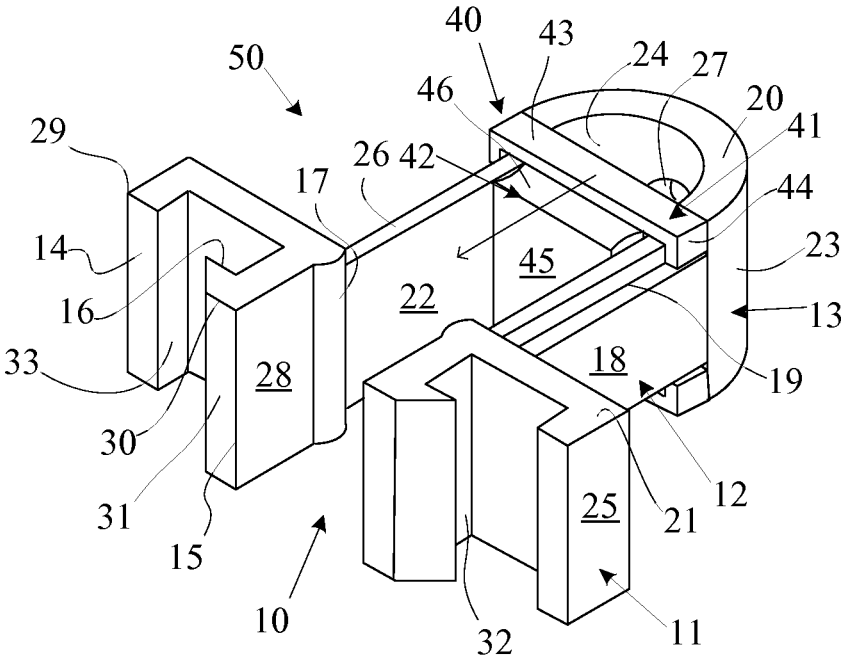
FIG. 1 is a front perspective view of an exemplary embodiment of a channel clip in an unlocked configuration.

FIG. 1 shows an exemplary embodiment of a channel clip 50. Channel clip 50 may include an anchoring portion 10 and a sliding portion 40. Anchoring portion 10 may include a pair of feet 11 and a pair of legs 12, which may be held together by a flexible joining section 13. Feet 11 can include a retaining head portion 15 and a bulb-out portion 17, a top surface 21 and a flange portion 29. Sliding portion 40 can include a shoulder section 41 and a body section 42. Body section 42 of sliding portion 40 can further include side grooves, which may be sized and shaped to receive bulb-out portions 17 of feet 11. As shown in FIG. 1, when sliding portion 40 is positioned proximate flexible joining section 13, channel clip 50 may be in an unlocked configuration, which can allow for lateral movement of feet 11 such that feet 11 may be brought into closer proximity to each other, which can facilitate attaching channel clip 50 to a window channel or the like.

Still referring to FIG. 1, the retaining head portion 15 may include an inner surface 28, a tip 30 and an outer surface 32. Tip 30 can include an inner surface 16 and a forward surface 31 and may be substantially trapezoidally shaped. Flange portion 29 can include a forward surface 14, an outer surface 25 and an inner surface 33. Flange portion 29 and retaining head portion 15 can be disposed in substantially parallel planes and may be joined to each other by a joining portion, which may extend in a plane orthogonal to the planes of flange portion 29 and retaining head portion 15, and may be disposed proximate bulb-out portion 17. Each of legs 12 can include an outer surface 18, a rail portion 19 and an inner surface 22. The rail portion 19 may include a top surface 26. Flexible section 13 can include a flat top surface 20, a curved outer surface 23, a curved inner surface 24 and a mounting hole 27. Finally, the shoulder section 41 of the sliding portion 40 may include a top surface 43 and a side surface 44 while the body section 42 may include a front surface 45 and a top surface 44.

The top surfaces 21 of feet 11, top surface 43 of sliding portion 40, and top surface 20 of flexible section 14 may be coplanar. The surface of the side portion 44 of the shoulder section 41 may be tangent to the curved outer surface 23 of the flexible joining section 13. The width of the material in the anchor shaped clip may be uniform in all its constituent parts, including feet 11, legs 12 and flexible joining section 13, and may also be equal to the width of shoulder section 41 and body section 42 of the sliding portion 40.

Figure 2:
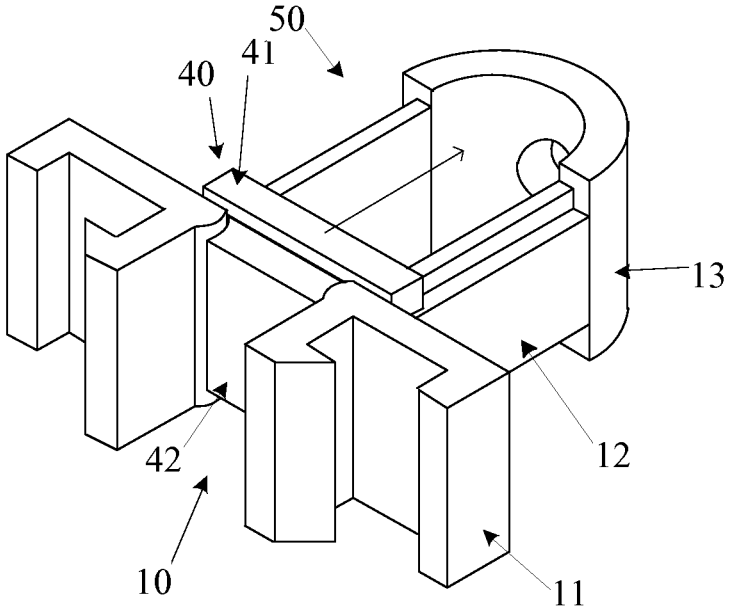
FIG. 2 is a front perspective view of an exemplary embodiment of a channel clip in a locked configuration.

FIG. 2 shows an exemplary embodiment of channel clip 50 having sliding portion 40 disposed proximate to feet 11. When sliding portion 40 is proximate feet 11, bulb-out portions 17 of feet 11 may be received within the side grooves of sliding portion 40. In such a configuration, sliding portion 40 can impede feet 11 from coming into closer proximity to each other, thereby placing channel clip 50 into a locked configuration. When channel clip 50 is affixed to a window channel or the like, the locked configuration can reduce the likelihood of channel clip 50 being withdrawn from the channel. Consequently, when it is desired to remove channel clip 50 from a window channel or the like, sliding portion 40 can be moved away from feet 11 so as to place channel clip 50 into an unlocked configuration. Sliding portion 40 can be moved between the locked and the unlocked positions when the necessary directional force is applied by an operator, for example on the shoulder sections 41 of sliding portion 40.

Figure 3:
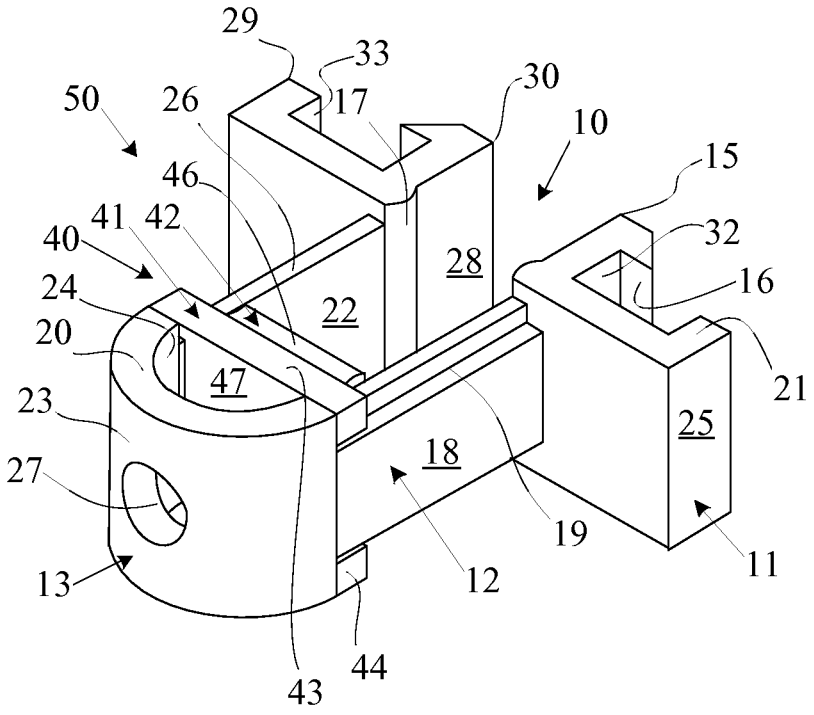
FIG. 3 is a rear perspective view of an exemplary embodiment of a channel clip in an unlocked configuration.
Figure 4:
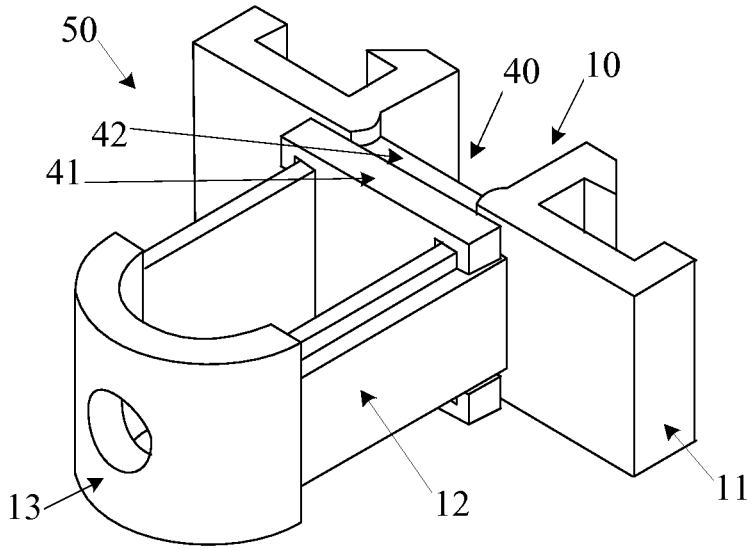
FIG. 4 is a rear perspective view of an exemplary embodiment of a channel clip in a locked configuration.

FIG. 3 shows a rear perspective view of an exemplary embodiment of channel clip 50, illustrating the back surface 47 of the sliding member 40 as well as the mounting hole 27. FIG. 3 further shows sliding member 40 proximate flexible section 13, channel clip 50 consequently being in the unlocked configuration. FIG. 4 shows a rear perspective view of an exemplary embodiment of channel clip 50 with sliding member 40 proximate feet 11, channel clip 50 consequently being in the locked configuration.

Figure 5:
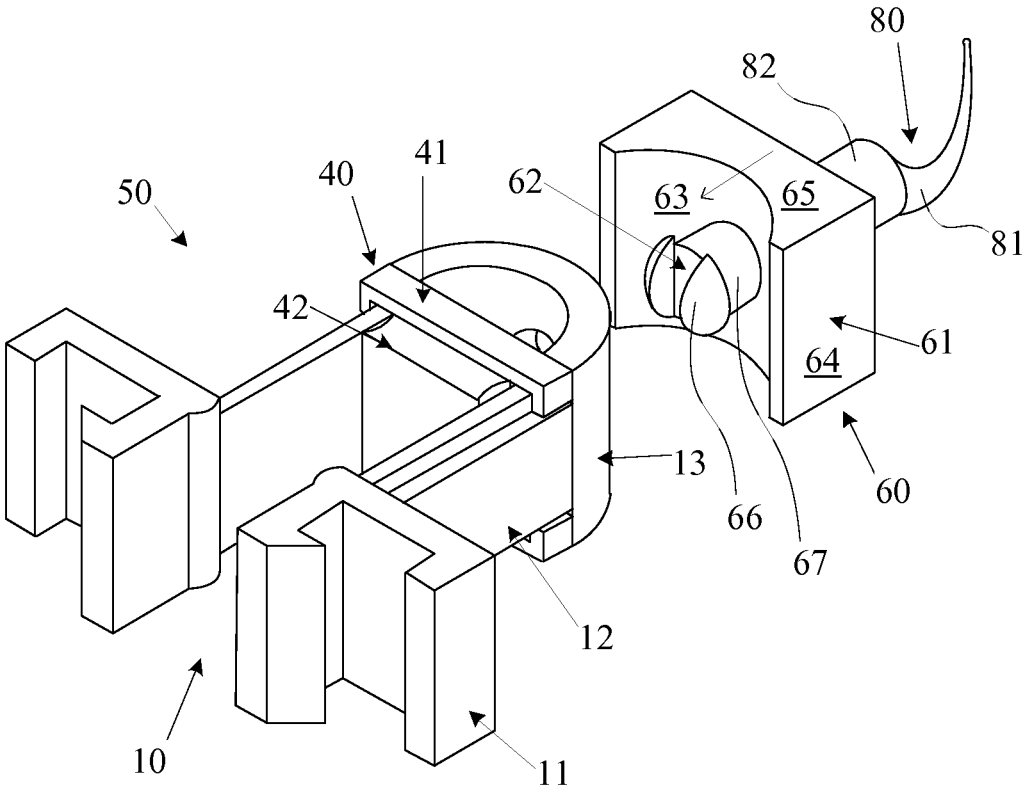
FIG. 5 is a front perspective view of an exemplary embodiment of a channel clip and an exemplary embodiment of an object holder.

FIG. 5 shows an exemplary embodiment of channel clip 50 and an exemplary embodiment of object holder 60. Object holder 60 can include a body section 61 and a push-in removable rivet 62. Body section 61 can include a curved inner surface 63, a flat outer surface 64 and a flat top surface 65. Curved inner surface 63 of object holder 60 may have a shape complementary to curved outer surface 23 of flexible joining section 13. Rivet 65 can include a head 66 and a shank 67. Head 66 of rivet 65 may be sized and shaped to be removably insertable through mounting hole 27. Object holder 60 may further include an object support portion 80, which can include a hook 81 and a shank 82. Object support portion 80 can be fixedly or removably coupled to object holder 60.

Figure 6:
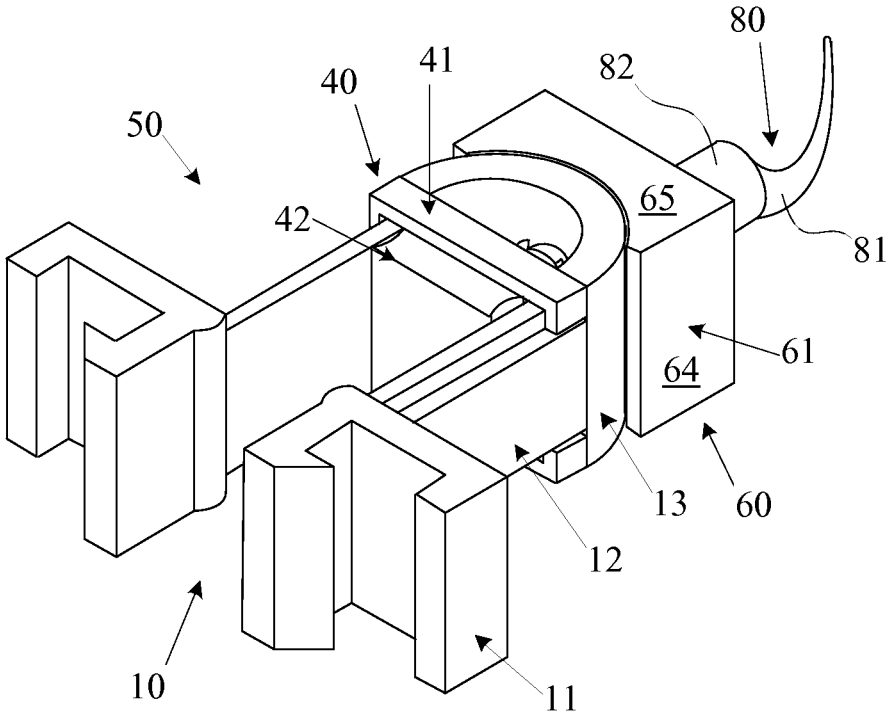
FIG. 6 is a front perspective view of an exemplary embodiment of a channel clip coupled to an exemplary embodiment of an object holder.
Figure 7:
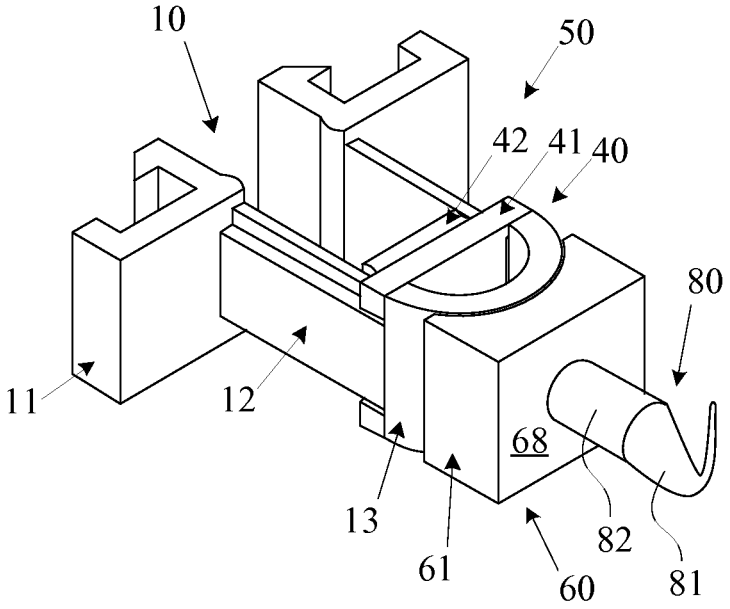
FIG. 7 is a rear perspective view of an exemplary embodiment of a channel clip coupled to an exemplary embodiment of an object holder.

FIGS. 6 and 7 show object holder 60 coupled to channel clip 50. The coupling of channel clip 50 and object holder 60 may be facilitated by the push-in removable rivet 62. The shank 67 may be inserted through the mounting hole 27 until the head 66 reaches the inner side of the flexible joining section 13. The head 66 may then snap open and rest against the curved inner surface 24 of flexible joining section 13, such that the curved inner surface 63 of object holder 60 and the curved outer surface 23 of flexible joining section 13 are disposed in contact with each other.

Figure 8:
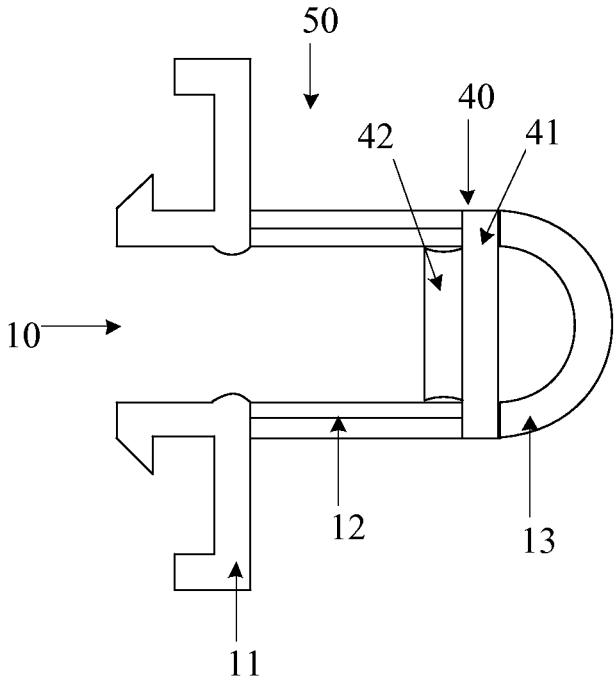
FIG. 8 is top view of an exemplary embodiment of a channel clip in an unlocked configuration.

FIG. 8 shows a top view of an exemplar embodiment of channel clip 50, with the sliding portion 40 in the unlocked position. In this configuration, the channel clip 50 can be easily inserted into a channel by applying inward pressure on the outer surface 18 of the leg sections 12 while pushing the anchoring portion 10 into the channel.

Figure 9:
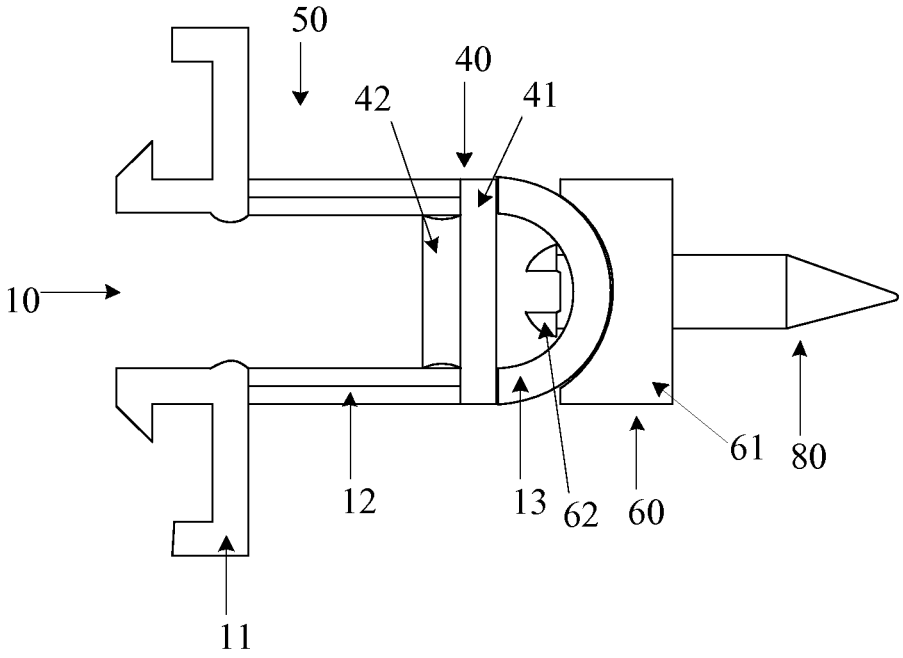
FIG. 9 is a top view of an exemplary embodiment of a channel clip coupled to an exemplary embodiment of an object holder.

FIG. 9 shows a top view of an exemplary embodiment of object holder 60 and object support portion 80 coupled to channel clip 50. The inner curved portion of the flexible joining section 13 can be sized so as to accommodate the push-in removable rivet 62 when the rivet 62 is disposed therein.

Figure 10:
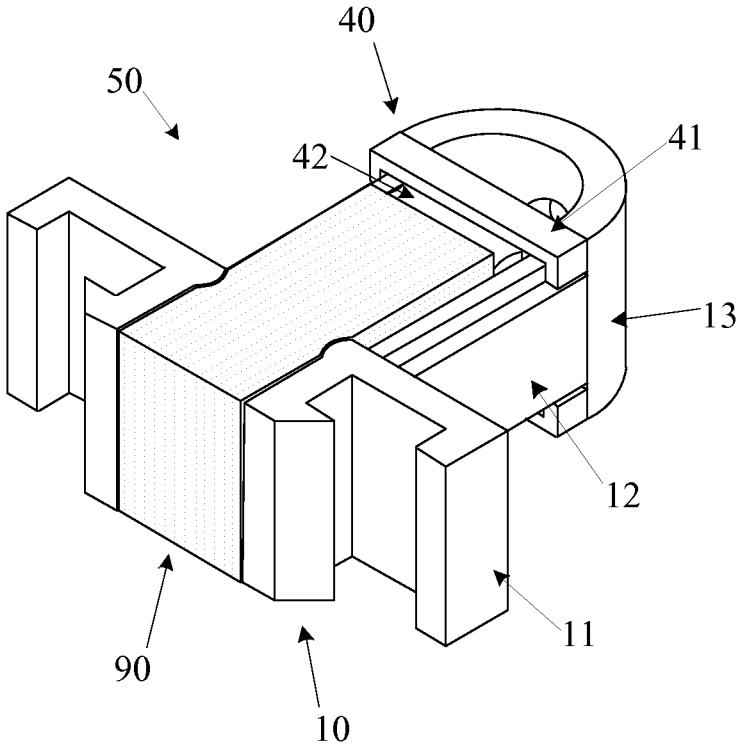
FIG. 10 is a front perspective view of an exemplary embodiment of a channel clip and an exemplary embodiment of a foam block in a first position.

FIG. 10 shows an exemplary embodiment of channel clip 50 with an exemplary embodiment of a foam block 90 disposed in the cavity between legs 12 and feet 11 of channel clip 50. When sliding portion 40 is in the unlocked position, as shown, foam block 90 can be disposed inside the cavity of the channel clip 50 so as to allow for insertion of channel clip 50 into the channel. Foam block 90 can be fixedly or removably coupled to the front surface 45 of the body section 42 of sliding portion 40. As non-limiting examples, if the channel clip 50 is intended to be used for sealing or insulation purposes, foam block 90 can be attached with an adhesive, for example during the manufacturing process. Alternatively, if channel clip 50 is intended to be used for support purposes, foam block 90 can be attached by the user, for example using a double sided adhesive band, hook-and-loop fasteners, or any similar fasteners known in the art.

Figure 11:
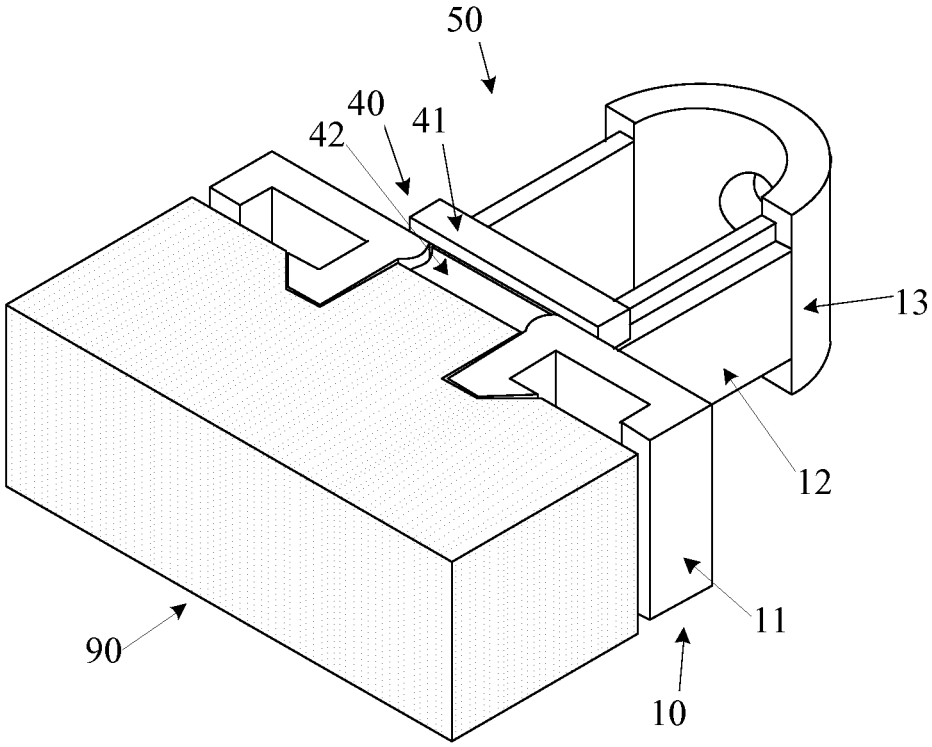
FIG. 11 is a front perspective view of an exemplary embodiment of a channel clip and an exemplary embodiment of a foam block in a second position.
Figure 12:
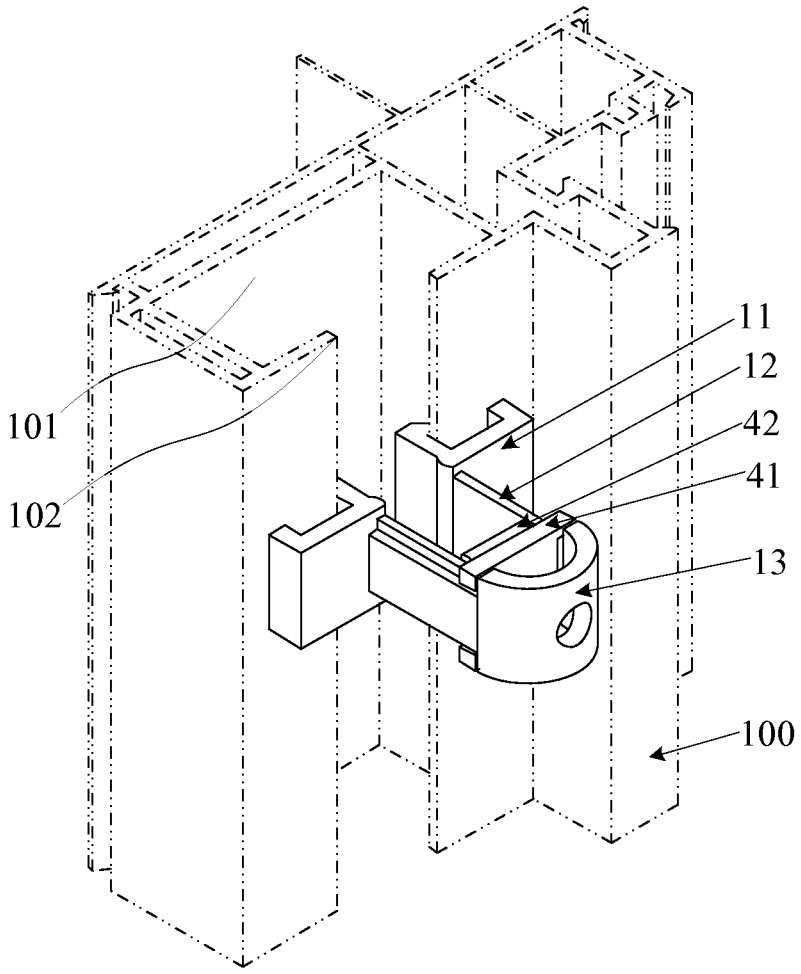
FIG. 12 is a perspective view of an exemplary embodiment of a channel clip in an unlocked configuration coupled to a window jamb channel.
Figure 13:
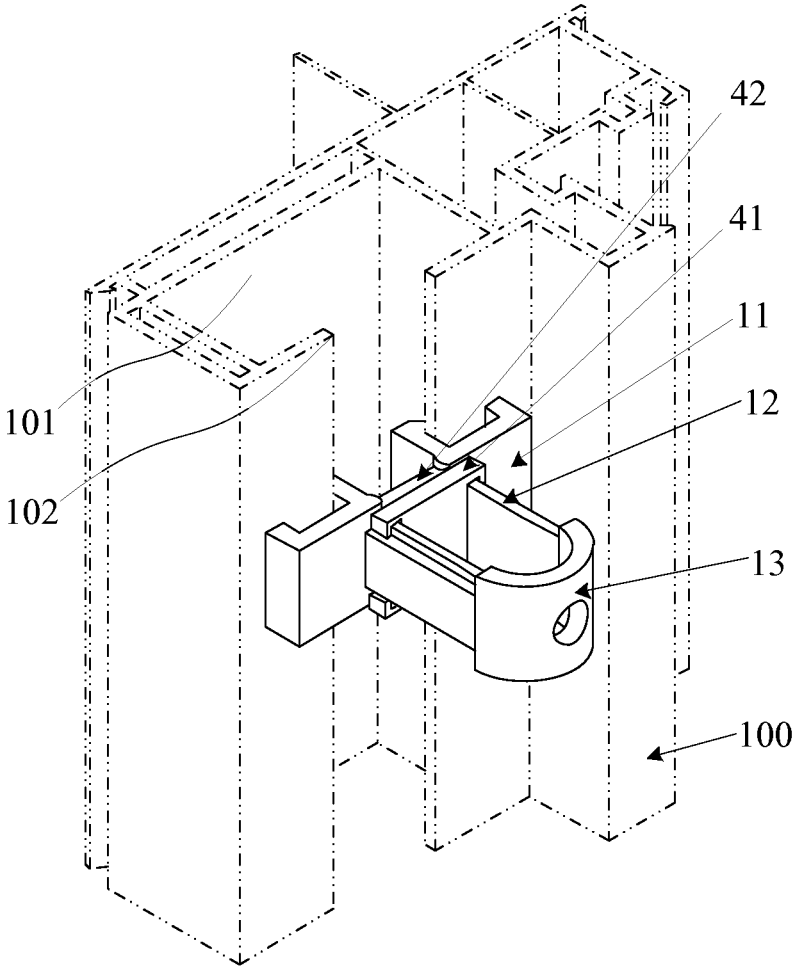
FIG. 13 is a perspective view of an exemplary embodiment of a channel clip in a locked configuration coupled to a window jamb channel.

FIG. 11 shows foam block 90 is shown in the expanded position. When sliding member 40 is disposed in the locked position, foam block 90 may be moved out of the cavity between legs 12 of channel clip 50, and can consequently expand outward beyond feet 11 of channel clip 50, so as to fill the channel to which channel clip 50 is attached.

In some exemplary embodiments, the components of channel clip 50, including anchoring portion 10 and sliding portion 40, as well as the object holder 60 and the object support portion 80 can be manufactured of a thermoplastic polymer such as, for example, polyvinyl chloride (PVC), or any other known materials having similar properties of elasticity and durability that allow channel clip 50 to function as described herein. Such components can be manufactured, for example, by plastic injection or extrusion. Foam block 90 may be made from a polyurethane foam or any other known material that enables foam block 90 to function as described herein.

Referring now to FIGS. 12-13 and FIGS. 16-18, the components of the channel attachment apparatus are shown in operation, coupled to a window jamb liner 100. The jamb liner channel 101 can house the hardware that provides support and allows for movement of the window sash 110 along the jamb liner 100. The jamb liner 100 is typically firmly attached to the window frame and therefore is capable of offering reliable support means for certain objects that might be displayed in the window such as signs, curtains, screens, thermometers, plant pots, etc. However, as such objects cannot attach directly to the jamb liner, the components of the channel attachment apparatus facilitate supporting such objects in a window by coupling with the jamb liner channel 101. This can be facilitated by inserting the anchoring portion 10 into the jamb liner channel 101, and attaching the desired object to object support portion 80 of object holder 60.

Figure 16:
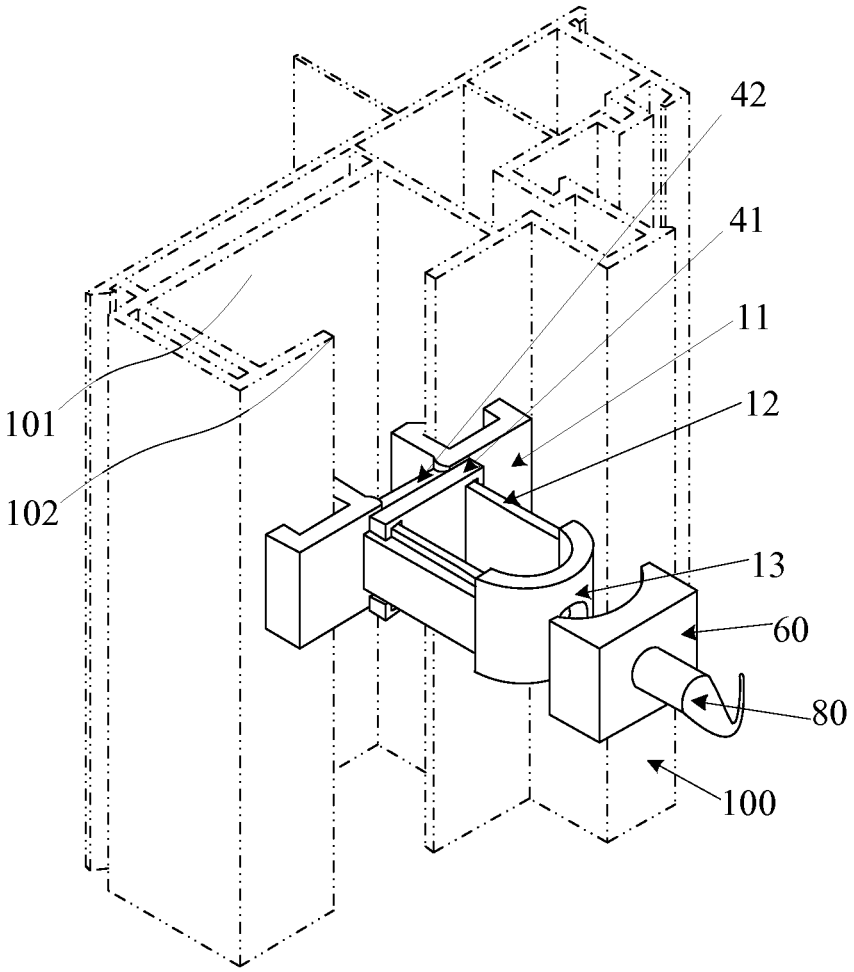
FIG. 16 is a perspective view of an exemplary embodiment of a channel clip coupled to a window jamb channel, with an exemplary embodiment of an object holder.
Figure 17:
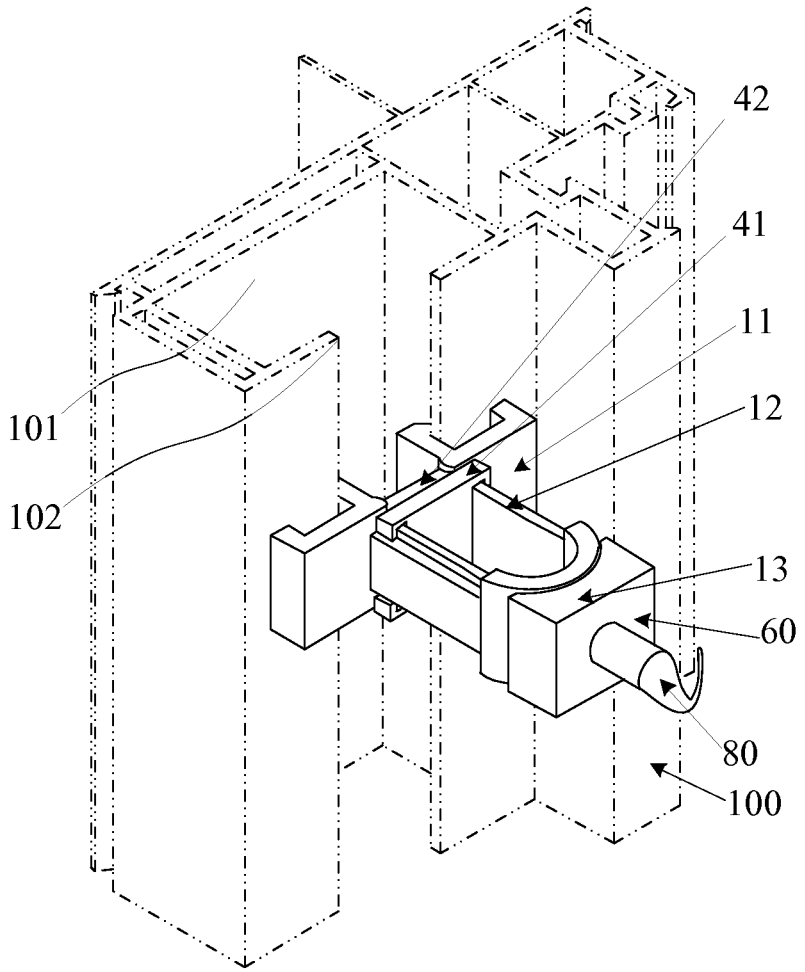
FIG. 17 is a perspective view of an exemplary embodiment of a channel clip coupled to a window jamb channel, coupled to an exemplary embodiment of an object holder.
Figure 18:
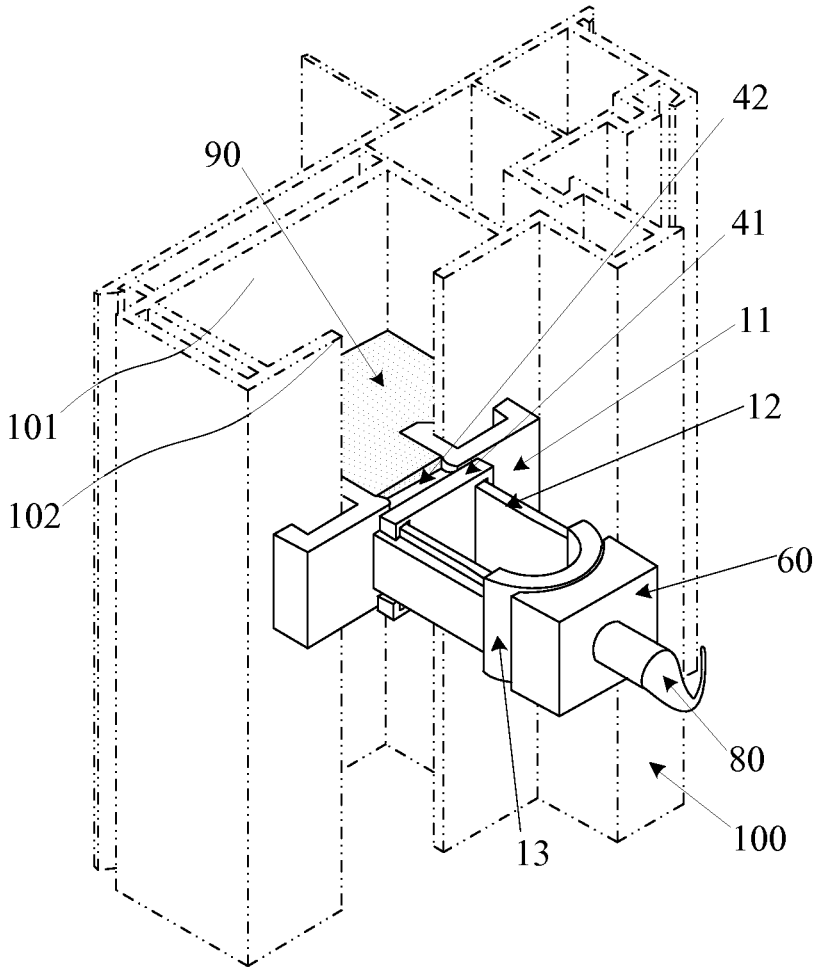
FIG. 18 is a perspective view of an exemplary embodiment of a channel clip coupled to a window jamb channel, coupled to an exemplary embodiment of an object holder, and with a foam block in a second position.
Figure 19:
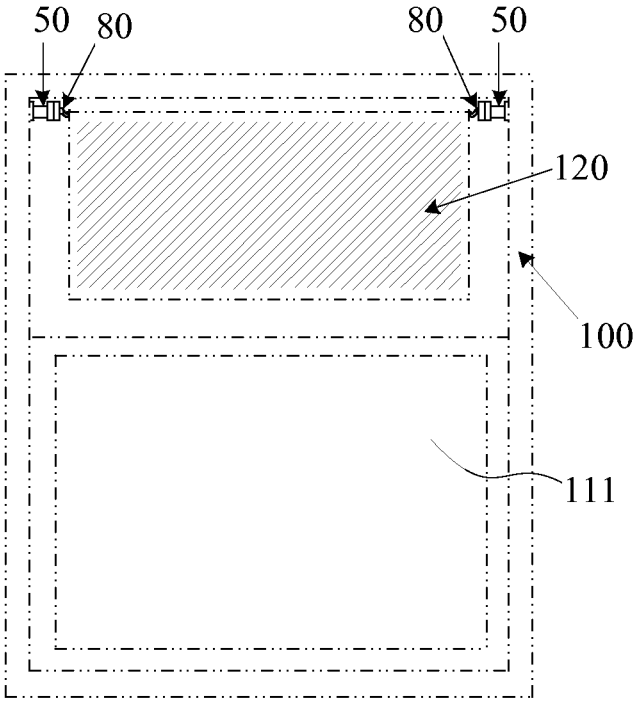
FIG. 19 is an elevational view of an object supported by a pair of exemplary window channel attachment apparatuses.

Still referring to FIGS. 12-13 and FIGS. 16-18, the retaining head portions 15 of feet 11 can be inserted into flange section 102 of the jamb liner channel 101. The forward surface 14 of flange portion 29 can rest on the outer surface of the jamb liner 100 while the inner surface 16 of the tip 30 may make contact with the inner surface of the jamb liner channel 101. The distance between forward surface 14 and inner surface 16 may be approximately equal to the width of the wall of the flange section 102, thereby facilitating a snap-fit mount of channel clip 50 into jamb channel 101. Further securing of the clip can be achieved by sliding member 40 into the locked position as shown in FIG. 13, FIG. 16, FIG. 17, and FIG. 18. Object holder 60 can then be attached as shown in FIG. 16 and FIG. 17 by inserting push-in removable rivet 62 into the mounting hole 27 such that head 66 of the push-in removable rivet 62 snaps open so as to be locked in the channel clip 50. The assembly formed by the channel clip 50, the object holder 60 and object support portion 80 can now support external objects, as shown in FIG. 19. For example, in FIG. 19, two channel clips 50 are affixed to opposing window jamb liners 100, and a window screen 120 is supported between the two channel clips 50.

Figure 14:
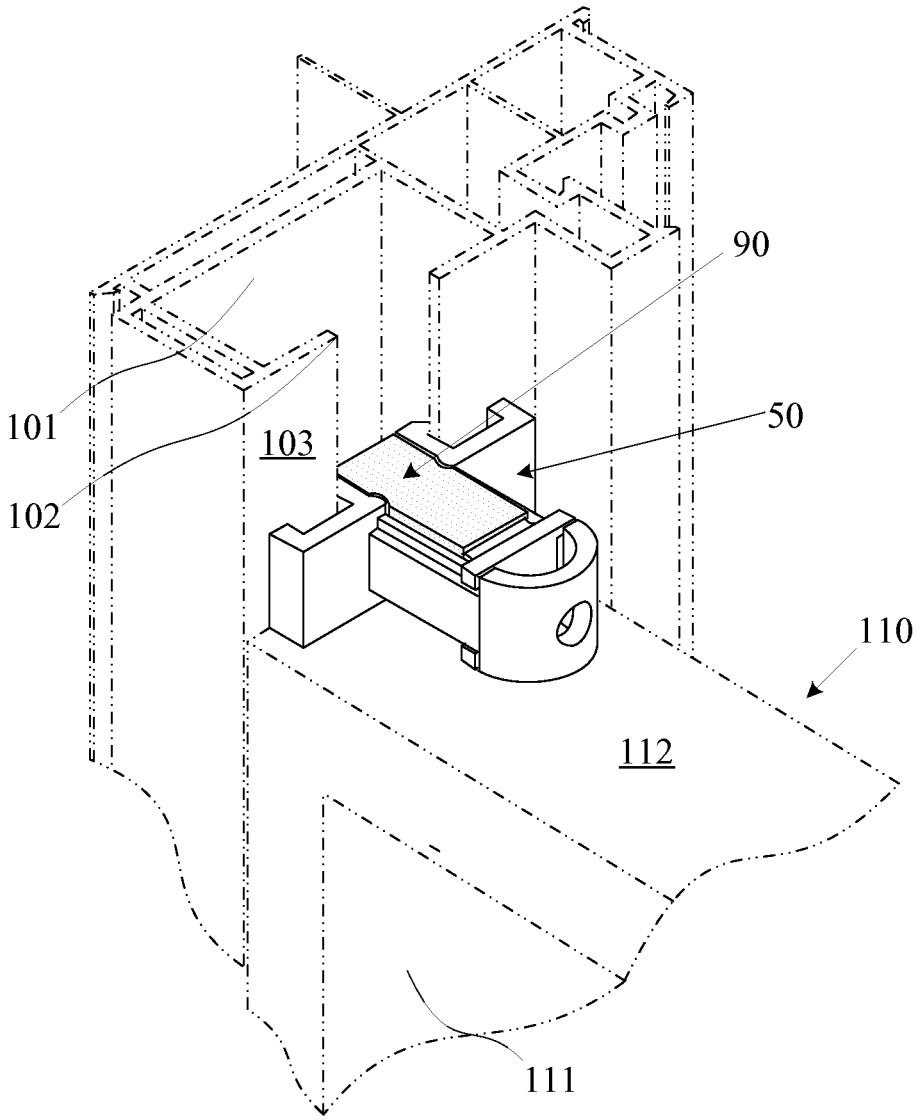
FIG. 14 is a perspective view of an exemplary embodiment of a channel clip coupled to a window jamb channel, with an exemplary embodiment of a foam block in a first position.
Figure 15:
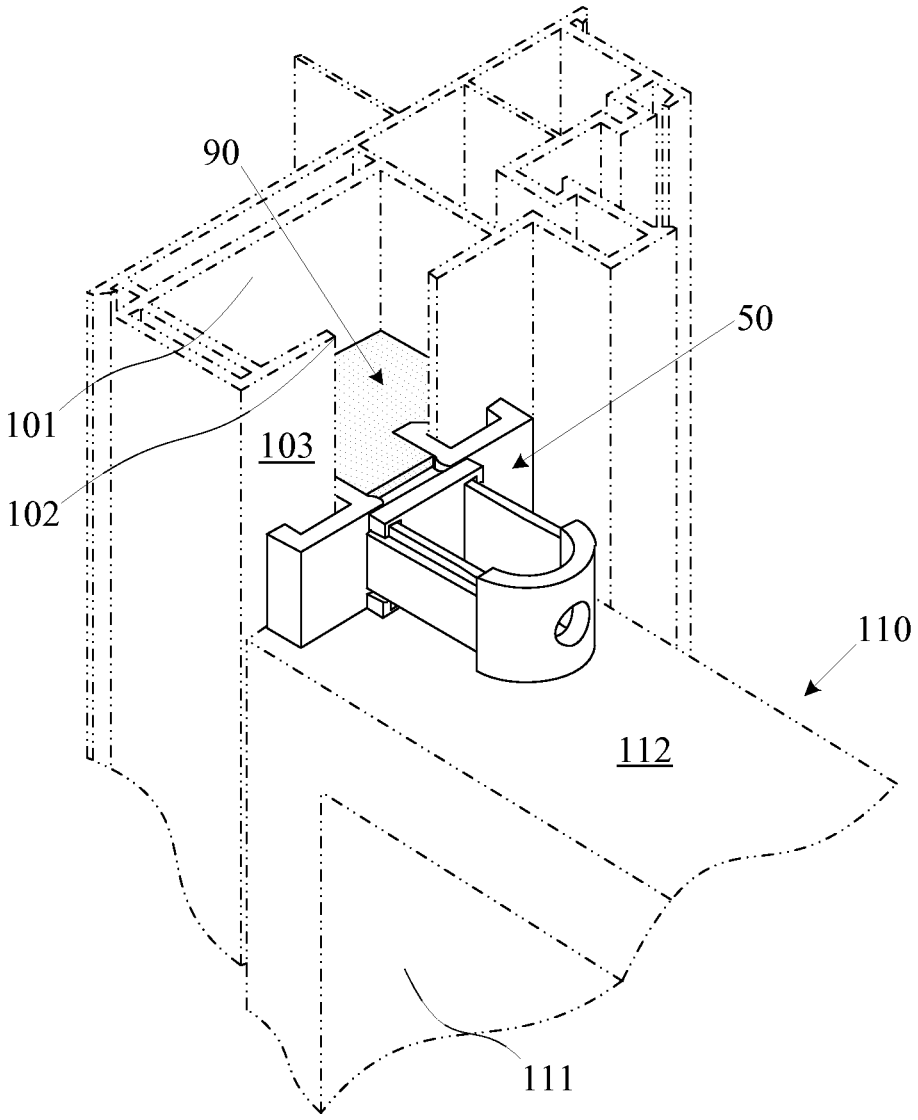
FIG. 15 is a perspective view of an exemplary embodiment of a channel clip coupled to a window jamb channel, with an exemplary embodiment of a foam block in a second position.

FIG. 14 and FIG. 15, show an exemplary embodiment of channel clip 50 in use in conjunction with an exemplary embodiment of foam block 90, so as to provide a sealing or insulation function. The foam block 90 is shown in the retracted position in FIG. 14 and in the expanded position in FIG. 15. To facilitate sealing or insulation, the channel clip 50 can be attached to the window jamb liner 100 such that it is flush with the window sash 110. In this position, the bottom surface (i.e., the surface opposite to the top surface 21) the channel clip 50 can be contact with the top side 112 of the window sash 110. Still referring to FIG. 14 and FIG. 15, for completeness only, the window glazing 111 is also shown. As the sliding portion 40 is moved from the unlocked position shown in FIG. 14 and into the locked position shown in FIG. 15, foam block 90 can expand into the jamb channel 101 so as to facilitate the sealing or insulation function.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A window jamb channel attachment apparatus, comprising:

a channel clip including an anchoring portion for removably coupling to a window jamb channel, wherein the anchoring portion includes:

a first leg with first foot on a first end of the first leg;

a second leg with a second foot on a first end of the second leg;

a flexible joining section connected to a second end of the first leg and a second end of the second leg;

an object holding portion coupled to the channel clip;

a movable member coupled to the channel clip between the first leg and the second leg, the movable member being movable along a length of the first leg and the second leg between a first position proximate the flexible joining section, and a second position proximate the first foot and the second foot;

wherein, when the moveable member is in the second position, the distance between the first foot and the second foot is variable; and wherein, when the movable member is in the second position, the distance between the first foot and the second foot is fixed.

2. The window jamb channel attachment apparatus of claim 1, wherein the object holding portion is removably coupled to the channel clip.

3. The window jamb channel attachment apparatus of claim 2, wherein the object holding portion is adapted to support an object or a portion of an object.

4. The window jamb channel attachment apparatus of claim 1, further comprising a sealing element coupled to the channel clip.

5. The window jamb channel attachment apparatus of claim 4, wherein, when the channel clip is coupled to a window jamb channel, the sealing element is movable into the window jamb channel.

6. A window jamb channel attachment apparatus, comprising:

a channel clip, the channel clip including a first foot, a second foot, a first leg, a second leg, and a joining portion, the first foot and the second foot adapted to couple to a window jamb channel, the first leg having a first end coupled to the first foot and a second end coupled to the joining portion, the second leg having a first end coupled to the second foot and a second end coupled to the joining portion, the joining portion including an aperture defined therein;

a movable member coupled to the channel clip between the first leg and the second leg, the movable member being movable along a length of the first leg and the second leg between a first position proximate the joining portion, and a second position proximate the first foot and the second foot;

wherein, when the movable member is in the first position, the distance between the first foot and the second foot is variable; and wherein, when the movable member is in the second position, the distance between the first foot and the second foot is fixed; and an object holder removably coupled to the channel clip, the object holder including a body, a fastener portion sized and shaped to be received in the aperture of the channel clip, and an object support portion.

7. The window jamb channel attachment apparatus of claim 6, wherein the joining portion includes a flexible section.

8. The window jamb channel apparatus of claim 6, further comprising a sealing element coupled to the movable member.

9. The window jamb channel apparatus of claim 8, when the channel clip is coupled to a window jamb channel, the sealing element is movable into the window jamb channel.

10. The window jamb channel attachment apparatus of claim 6, wherein the object support portion includes a hook.

11. A method for supporting objects from window jambs, comprising:

removably coupling at least one channel clip to a window jamb channel, the at least one channel clip including a first foot, a second foot, a first leg, a second leg, and a joining portion, the first leg having a first end coupled to the first foot and a second end coupled to the joining portion, the second leg having a first end coupled to the second foot and a second end coupled to the joining portion;

moving a movable member, wherein the movable member is coupled to the channel clip between the first leg and the second leg, the movable member being movable along a length of the first leg and the second leg between a first position proximate the joining portion, and a second position proximate the first foot and the second foot;

varying the distance between the first foot and the second foot when the movable member is in the first position to engage the window jamb channel;

moving the movable member to a second position proximate the first foot and the second foot to lock the channel clip by impeding any variation of distance between the first foot and the second foot;

removably coupling an object holding portion to the at least one channel clip; and attaching an object to the object holding portion.

12. The method of claim 11, further comprising removably coupling a foam block to the at least one channel clip.

13. The method of claim 11, wherein removably coupling at least one channel clip to a window jamb channel comprises:

placing the movable first position; and inserting varying the distance between the pair of foot portions to alter the channel clip within the window jamb channel or remove the channel clip from the window jamb channel.

* * * * *